US009855775B1

(12) United States Patent
Herrmann et al.

(10) Patent No.: US 9,855,775 B1
(45) Date of Patent: Jan. 2, 2018

(54) APPARATUS AND METHOD FOR PROTECTING PRINTHEADS FROM IRREGULAR MEDIA IN A PRINTER

(71) Applicant: Xerox Corporation, Norwalk, CT (US)

(72) Inventors: Douglas K. Herrmann, Webster, NY (US); Jason M. LeFevre, Penfield, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/375,355

(22) Filed: Dec. 12, 2016

(51) Int. Cl.
*B41J 25/00* (2006.01)

(52) U.S. Cl.
CPC ..... *B41J 25/001* (2013.01)

(58) Field of Classification Search
CPC ..... B41J 25/001
See application file for complete search history.

(56) References Cited

U.S. PATENT DOCUMENTS

| | | | | |
|---|---|---|---|---|
| 4,884,909 | A | 12/1989 | Watanabe et al. | |
| 4,888,602 | A | 12/1989 | Watanabe et al. | |
| 5,019,839 | A | 5/1991 | Watanabe et al. | |
| 7,134,658 | B2 * | 11/2006 | Shimomura | B65H 1/022 271/127 |
| 7,316,477 | B2 * | 1/2008 | Yoda | B41J 11/0025 271/198 |
| 8,827,581 | B2 | 9/2014 | Tsuchiya et al. | |
| 9,199,466 | B1 | 12/2015 | Herrmann et al. | |
| 9,409,396 | B2 | 8/2016 | Herrmann et al. | |

* cited by examiner

*Primary Examiner* — Lamson Nguyen
(74) *Attorney, Agent, or Firm* — Maginot Moore & Beck LLP

(57) ABSTRACT

A printhead protection apparatus moves between printheads in a printer between a position where cross-members in a frame block media irregularities from striking the faces of the printheads and a position where the cross-members are retracted between adjacent printheads to enable the faces of the printheads to be wiped. The frame of the apparatus encompasses the printheads and the cross-members connected to the frame move between adjacent printheads.

14 Claims, 3 Drawing Sheets

APPARATUS AND METHOD FOR PROTECTING PRINTHEADS FROM IRREGULAR MEDIA IN A PRINTER

TECHNICAL FIELD

This disclosure is directed to printers that use printheads to form ink images on media and, more particularly, to mechanisms for protecting the printheads in such printers from errant media.

BACKGROUND

Drop on demand inkjet technology for producing printed images has been employed in products such as printers, multifunction products, plotters, and facsimile machines. Generally, an ink image is formed by selectively ejecting ink drops from a plurality of ejectors or inkjets, which are arranged in an array within a printhead, onto an image receiving substrate. For example, the image receiving substrate may be moved relative to the printhead and the inkjets may be controlled to eject ink drops through nozzles formed in the printhead at appropriate times. The timing of the inkjet activation is performed by a printhead controller, which generates firing signals that activate the inkjets to eject ink. The ink ejected from the inkjets is liquid ink, such as aqueous, solvent, oil based, curable ink, or the like. The ink is stored in containers installed in the printer and the containers are fluidly connected to the printheads. Alternatively, the ink may be loaded in a solid or a gel form and delivered to a melting device, which heats the ink to generate liquid ink that is supplied to a printhead.

The ink by an inkjet travels through an air gap between the printhead face and the image receiving substrate. The greater the distance between the printhead face and the image receiving member, the greater the expelled ink drop speed and consistency required to travel this distance and land on the substrate at the position intended for the ejected ink drops. Inkjet printers that print images on precut sheets of print media are referred to as cut sheet inkjet printers. Cut sheet inkjet printers strip media sheets from a supply of media sheets stacked on an input tray. A media conveyer transports each stripped media sheet through a print zone of the printer where the printheads are located. The inkjets of the printheads eject ink onto the print media as the media conveyer transports the print media through the print zone. After receiving ink from the inkjets, the media conveyer transports the stripped media sheet to an output tray. Once received by the output tray the media sheets are collected by a user or received by another printing system for further processing. In continuous sheet printers, media is pulled from a rotating roll and actuators driving rollers propel the sheet through the printer past the printheads and post-printing processing equipment to a take-up roll.

In cut-sheet printers, some media sheets stripped from the input tray may include creases and other imperfections. Additionally, water from the ink landing on a media sheet can cause a portion of the sheet to curl, which increase the sheet's height above the transport. In continuous sheet printers, the risk of sheet curl is also present. If a portion of a media sheet actually touches the face of a printhead, a significant danger exists of disrupting the complete functioning of one or more of the jets. This disruption might be either temporary or permanent but in either case the image quality suffers significantly. Therefore, protecting printheads in cut sheet and continuous sheet printers from media passing by the printheads would be useful.

SUMMARY

A new apparatus helps protect the faceplate of printheads arranged in an array within a printer. The apparatus includes a frame having four members, each member having a first end and a second end, the first end of a first member is connected to the first end of a second member and the second end of the first member is connected to the first end of a third member and the first end of a fourth member is connected to the second end of the second member and the second end of the fourth member is connected to the second end of the third member, a plurality of cross-members mounted to the frame, each cross-member having a first end and a second end, the first end of each cross-member is connected to the first member of the frame and the second end of each cross-member is connected to the fourth member, the cross-members being separated from an adjacent cross-member by a distance corresponding to a width of a printhead in a direction perpendicular to a path of media movement in the plane of the media movement, each cross-member between positioned adjacent to at least one printhead in a plurality of printheads that are oriented parallel to one another, an actuator operatively connected to the frame, the actuator being configured to move the frame between a first position and a second position, when the frame is in the first position, a portion of each cross-member extends into a space between the printheads and the media passing the printheads, and when the frame is in the second position, no portion of each cross-member extends into the space between the printheads and the media passing the printheads, and a controller operatively connected to the actuator. The controller is configured to operate the actuator to move the frame between the first and second positions to extend the portions of the cross-members into the space between the printheads and the media passing the printheads selectively.

A printer incorporates the apparatus to help protect the faceplate of printheads arranged in an array within a printer. The printer includes a plurality of printheads arranged in an array and oriented to be parallel to one another, the printheads being configured to eject drops of ink, a media transport configured to move media past the printheads in a media movement direction to receive the drops of ink ejected by the printheads, a frame having four members, each member having a first end and a second end, the first end of a first member is connected to the first end of a second member and the second end of the first member is connected to the first end of a third member and the first end of a fourth member is connected to the second end of the second member and the second end of the fourth member is connected to the second end of the third member, a plurality of cross-members mounted to the frame, each cross-member having a first end and a second end, the first end of each cross-member is connected to the first member of the frame and the second end of each cross-member is connected to the fourth member, the cross-members being separated from an adjacent cross-member by a distance corresponding to a width of one printhead in a direction that is perpendicular to the media movement direction in the plane of the media movement, each cross-member between positioned adjacent to at least one printhead in the plurality of printheads, an actuator operatively connected to the frame, the actuator being configured to move the frame between a first position and a second position, when the frame is in the first position, a portion of each cross-member extends into a space between a plane formed by faces of the printheads and a plane through which the media passes by the printheads, and when the frame is in the second position, no portion of each cross-member extends into the space between the plane formed by the faces of the printheads and the plane through which the media passes the printheads, and a controller operatively connected to the actuator, the media transport, and the printheads in the plurality of printheads. The controller is configured to operate the media transport to move media past the printheads in the media movement direction, to operate the printheads to eject ink drops onto the media as the media passes the printheads, and to operate the actuator to move the frame between the first and second positions to extend the portions of the cross-members into the space between the plane formed by the faces of the printheads and the plane through which the media passes the printheads selectively.

A new method of operating a printer helps protect the faceplate of printheads arranged in an array within a printer. The method includes operating with a controller a media transport to move media past a plurality of printheads in a media movement direction, operating with the controller the printheads to eject ink drops onto the media as the media passes the printheads, and operating with the controller an actuator operatively connected to a frame having a plurality of cross-members that extend between a first member of the frame and a second member of the frame, the operation of the actuator moves the frame having the plurality of cross-members from a first position to a second position to extend portions of the cross-members into a space between a plane formed by faces of the printheads and a plane through which the media passes the printheads selectively.

BRIEF DESCRIPTION OF THE DRAWINGS

The foregoing aspects and other features of an apparatus that helps protect printheads in a printer from strikes by passing media are explained in the following description, taken in connection with the accompanying drawings.

DETAILED DESCRIPTION

Figure 1:
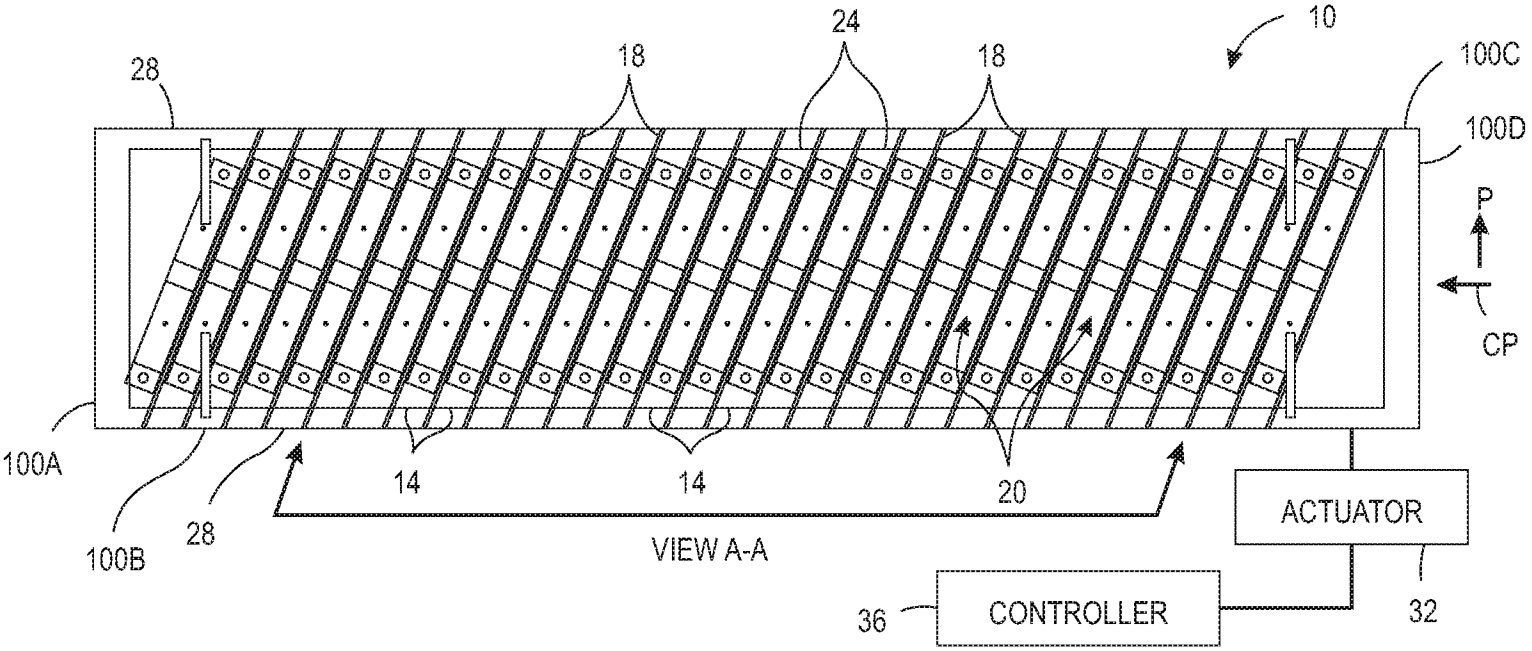
FIG. 1 depicts a print zone in a printer having an apparatus for protecting the printheads from irregular media structures.

A print zone 10 in which an array of printheads 14 are located with a configuration of guide members is shown in FIG. 1. The printheads 14 are arranged in a 1×29 array. The printheads are oriented parallel to one another to enable adjacent printheads to form a straight line of ink drops across a sheet of media moving past the printheads in direction indicated by the P arrow. That is, the plane of the media is parallel to a plane formed by the faces of the printheads 14. Each printhead 14 has a shoulder that prevents the edges of the faces 20 of adjacent printheads from contacting one another. Thus, the shoulders form gaps 24 between adjacent printheads 14. A frame 28 has cross-members 18 that oriented at the same angle as the printheads 14 are to the media movement direction P. The frame 28 is operatively connected to an actuator 32, which is operatively connected to a controller 36. The actuator 32 is configured to move the frame 28 into and out of the plane formed by the faces 20 of the printheads 14. Although the printheads 14 are shown as being oriented at an acute angle to the media direction P, the printheads could be oriented at other angles including being perpendicular to the media direction P. The direction CP is the cross-process direction, which is perpendicular to the media movement direction P in the plane of the media movement.

In further detail, the frame 28 includes four members 100*a*, 100*b*, 100*c*, and 100*d*. Each member has two ends. One end of member 100*b* is connected to one end of member 100*a* and the other end of member 100*b* is connected to one end of member 100*d*. Similarly, one end of member 100*c* is connected to the other end of member 100*a* and the other end of member 100*c* is connected to the other end of member 100*d*. Frame 28 can be formed by connecting the four members 100*a*, 100*b*, 100*c*, and 100*d* mechanically by brazing, welding, fasteners, or adhesives. Alternatively, the members can be formed into frame 28 integrally by injection molding or casting. The length of the frame 28 in the cross-process direction CP exceeds the distance from a rightmost printhead and a leftmost printhead. Likewise, the width of the frame 28 in the media movement direction P exceeds the width of the printheads in the media movement direction P. That is, the frame 28 is configured to encompass the printhead array in the print zone 10 in a plane parallel to the faces of the printhead array.

Figure 2:
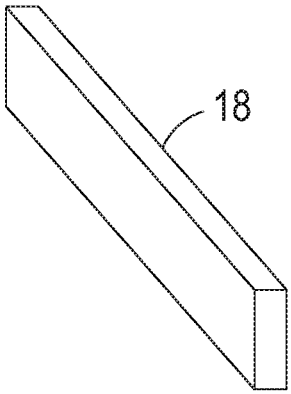
FIG. 2 is a perspective view of a rectangular cross-member used in the apparatus shown in FIG. 1.
Figure 3:
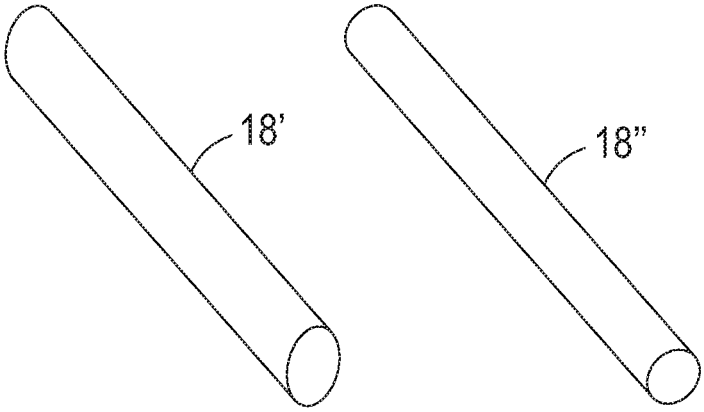
FIG. 3 is a perspective view of an elliptical and circular cross-member that can be used in the apparatus of FIG. 1.

As shown in FIG. 2, an exemplary cross-member 18 is a member having two ends and a rectangular cross-section, although the cross-members can be configured with elliptical 18', circular 18", or other cross-sections as shown in FIG. 3. A longitudinal axis of cross-member 18 has a length from one end to the other end of the cross-member 18 that spans the distance between member 100*b* and 100*c* of frame 28. The two ends of the cross-member 18 can be connected perpendicularly to the members 100*b* and 100*c* or the two ends can be connected at an angle as shown in FIG. 1. The orientation of the cross-member ends to the longer members of the frame 28 depends upon the orientation of the printheads 14 in the array of printheads. Thus, the cross-members 18 and the frame 28 can form a parallelogram as shown in FIG. 1 to accommodate the slanted orientation of the printheads, although other configurations in the shape of a rectangle, for example, can be used to accommodate printheads oriented in a more orthogonal manner. The distance between adjacent cross-members 18 in the frame 28 is slightly larger than between adjacent printheads in the direction of the media movement past the printheads. The width of a cross-member 18 is slightly less than the distance between adjacent printheads in the cross-process direction CP. The height of a cross-member 18 in a direction perpendicular to the plane in which the media moves past the printheads is less than a distance from the face of a printhead to the top of the member to which the printhead is mounted. In some embodiments, the cross-members 18 are connected to the members 100*b* and 100*c* of frame 28 mechanically by brazing, welding, fasteners, or adhesives. In other embodiments, the cross-members 18 can be integrally formed with the frame 28 by injection molding or casting. The first cross-member 18 is positioned adjacent to the rightmost printhead as shown in FIG. 1.

Figure 4:
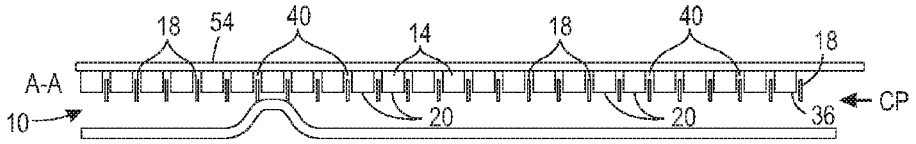
FIG. 4 is a side view of the print zone shown in FIG. 1 in which the cross-members of the apparatus for protecting the printheads from irregular media structures are positioned between the printheads and the media being printed.

With continued reference to FIG. 1 and to FIG. 4, the cross-members 18 are fixedly mounted at each end to the frame 28 as described above to enable the cross-members to be moved in response to the actuator 32 moving the frame 28. In FIG. 4, the process direction P is into the plane of the figure. Each cross-member 18 fits within one of the gaps 40 between adjacent printheads 14. The cross-members are sufficiently rigid that they do not deform when struck by irregular media, such as wrinkle 50 in the cross-process direction CP passing through the print zone 10. That is, they have a cross-sectional area that is large enough and made with a rigid material that impact with irregular media deflects the irregular structure rather than causing the cross-member to deform. Thus, the cross-members are thicker than wires and are more appropriately called rods or the like. The width of the cross-members in the cross-process direction CP, however, cannot exceed the distance across the gaps between adjacent printheads 14. Additionally, the height of the cross-members 18, as shown in FIG. 4, cannot be equal to the height of the gaps between adjacent printheads to provide sufficient volume for retracting the cross-members 18 within the gaps so the surface of the cross-members closest to the media path becomes at least flush with the plane formed by the faces 20 of the printheads 14. Thus, the cross-members 18 are unsupported by the member 54 to which the printheads 14 are mounted. This structure differs from previously known cross-member structures that either contact or are close enough to an underlying support structure that the portions of the cross-members that extend past a printhead into the gap G between the printheads and the media 56 are deflected into the underlying face of a printhead or other support member to prevent the cross-member from exiting the gap G completely. That is, these previously known protection devices require an underlying support member to preserve the structural integrity of the cross-member in the gap G. The frame 28 and cross-members 18 are sufficiently rigid that the cross-members 18 do not deflect into the gap between adjacent printheads when struck by irregular media features, such as the wrinkle 50 shown in FIG. 4.

Figure 5:
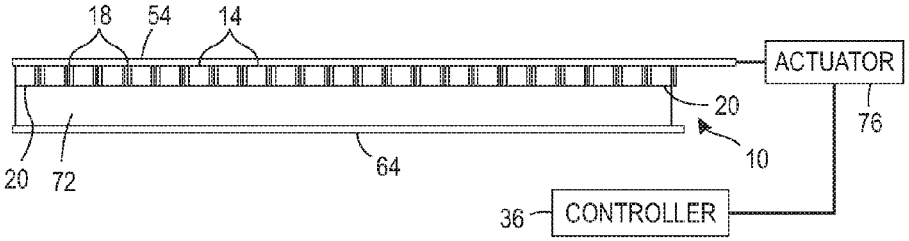
FIG. 5 is a side view of the print zone shown in FIG. 1 in which the cross-members of the apparatus for protecting the printheads from irregular media structures are positioned in the gaps between the printheads to enable wiping of the printhead faces.

FIG. 5 depicts the protection apparatus described above during a maintenance operation on the printheads 14. The controller 36 operates actuator 76 to move a member 64 into the print zone 10. A wiper 72 is mounted to the member 64. The controller 36 is also configured to pivot the member 64 so the wiper 72 can be rotated into contact with the faces 20 of the printheads 14 and rotated out of contact with the faces. After the wiper 72 is rotated into contact with the faces 20, the controller 36 operates the actuator 76 to move the member 64 in the media process direction to wipe the faces 20 of each printhead 14 in the print zone 10. This wiping typically occurs after a purging operation has been performed on one or more of the printheads. To prevent the wiper from bumping over or becoming stuck on the cross-members 18, the controller 36 operates the actuator 32 (FIG. 1) to move the frame 28 away from the gap between the printhead faces 20 and the media path to retract the cross-members 18 into the gaps between the printheads 14 or the gap beside the rightmost printhead as shown in the figure. In this position, the cross-members 18 are close to or contact the member 54 and the end of the cross-members opposite the end contacting the member 54 are completely within the gaps between adjacent printheads. Consequently, the cross-members 18 do not interfere with the wiper 72 as it moves through the print zone 10 to wipe each of the printheads 14. The actuator 76 can be configured to move the member 64 bidirectionally so the wiper 72 can return through the print zone 10 to wipe the face 20 of each printhead 14 in the opposite direction. Regardless whether the wiper 72 travels unidirectionally or bidirectionally through the print zone 10, once the wiper 72 completes the wiping operation and exits the print zone 10, the controller 36 operates the actuator 32 to move the frame 28 toward the media path to return the cross-members to the positions shown in FIG. 4 to guard the faces 20 of the printheads 14 from irregular media structures. It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. An apparatus for protecting printhead faces from irregular media structures comprising:

a frame having four members, each member having a first end and a second end, the first end of a first member is connected to the first end of a second member and the second end of the first member is connected to the first end of a third member and the first end of a fourth member is connected to the second end of the second member and the second end of the fourth member is connected to the second end of the third member;

a plurality of cross-members mounted to the frame, each cross-member having a first end and a second end, the first end of each cross-member is connected to the first member of the frame and the second end of each cross-member is connected to the fourth member, the cross-members being separated from an adjacent cross-member by a distance corresponding to a width of a printhead in a direction perpendicular to a path of media movement in the plane of the media movement, each cross-member between positioned adjacent to at least one printhead in a plurality of printheads that are oriented parallel to one another;

an actuator operatively connected to the frame, the actuator being configured to move the frame between a first position and a second position, when the frame is in the first position, a portion of each cross-member extends into a space between the printheads and the media passing the printheads, and when the frame is in the second position, no portion of each cross-member extends into the space between the printheads and the media passing the printheads; and a controller operatively connected to the actuator, the controller being configured to operate the actuator to move the frame between the first and second positions to extend the portions of the cross-members into the space between the printheads and the media passing the printheads selectively.

2. The apparatus of claim 1 wherein the members of the frame are configured as a parallelogram.

3. The apparatus of claim 2 wherein the members of the frame are configured as a rectangle.

4. The apparatus of claim 1 wherein each cross-member of the frame has a rectangular cross-section.

5. The apparatus of claim 1 wherein each cross-member of the frame has a circular cross-section.

6. The apparatus of claim 1 wherein each cross-member of the frame has an elliptical cross-section.

7. The apparatus of claim 1 wherein the cross-members located at the second position are separated from a member to which the printheads are mounted by a distance that prevents the cross-members from contacting the member to which the printheads are mounted.

8. A printer comprising:

a plurality of printheads arranged in an array and oriented to be parallel to one another, the printheads being configured to eject drops of ink;

a media transport configured to move media past the printheads in a media movement direction to receive the drops of ink ejected by the printheads;

a frame having four members, each member having a first end and a second end, the first end of a first member is connected to the first end of a second member and the second end of the first member is connected to the first end of a third member and the first end of a fourth member is connected to the second end of the second member and the second end of the fourth member is connected to the second end of the third member;

a plurality of cross-members mounted to the frame, each cross-member having a first end and a second end, the first end of each cross-member is connected to the first member of the frame and the second end of each cross-member is connected to the fourth member, the cross-members being separated from an adjacent cross-member by a distance corresponding to a width of one printhead in a direction that is perpendicular to the media movement direction in the plane of the media movement, each cross-member between positioned adjacent to at least one printhead in the plurality of printhheads;

an actuator operatively connected to the frame, the actuator being configured to move the frame between a first position and a second position, when the frame is in the first position, a portion of each cross-member extends into a space between a plane formed by faces of the printheads and a plane through which the media passes by the printheads, and when the frame is in the second position, no portion of each cross-member extends into the space between the plane formed by the faces of the printheads and the plane through which the media passes the printheads; and a controller operatively connected to the actuator, the media transport, and the printheads in the plurality of printheads, the controller being configured to operate the media transport to move media past the printheads in the media movement direction, to operate the printheads to eject ink drops onto the media as the media passes the printheads, and to operate the actuator to move the frame between the first and second positions to extend the portions of the cross-members into the space between the plane formed by the faces of the printheads and the plane through which the media passes the printheads selectively.

9. The printer of claim 8 wherein the printheads of the plurality of printheads are slanted with respect to the direction perpendicular to the media movement direction in the plane of the media movement; and the members of the frame are configured as a parallelogram to encompass the plurality of printheads within the frame.

10. The printer of claim 8 wherein the printheads of the plurality of printheads are orthogonal to the media movement direction in the plane of the media movement; and the members of the frame are configured as a rectangle to encompass the plurality of printheads within the frame.

11. The printer of claim 8 wherein each cross-member of the frame has a rectangular cross-section.

12. The printer of claim 8 wherein each cross-member of the frame has a circular cross-section.

13. The printer of claim 8 wherein each cross-member of the frame has an elliptical cross-section.

14. The printer of claim 8 wherein the cross-members located at the second position are separated from a member to which the printheads are mounted by a distance that prevents the cross-members from contacting the member to which the printheads are mounted.

* * * * *